US005620330A

United States Patent [19]

Pizon

[11] Patent Number: 5,620,330

[45] Date of Patent: Apr. 15, 1997

[54] CONNECTOR FOR COAXIAL CABLE

[75] Inventor: Ernest Pizon, Saint Cloud, France

[73] Assignee: Mecaniplast, Aubergenville, France

[21] Appl. No.: 560,535

[22] Filed: Nov. 17, 1995

[51] Int. Cl.[6] ..... H01R 13/627

[52] U.S. Cl. ..... 439/350

[58] Field of Search ..... 439/350, 356, 439/923, 155, 156, 607, 675

[56] References Cited

U.S. PATENT DOCUMENTS

| | | | |
|---|---|---|---|
| 3,133,777 | 5/1964 | Anhalt | 439/350 |
| 3,694,793 | 9/1972 | Concelman | 439/675 |
| 3,742,426 | 6/1973 | Huber et al. . | |
| 3,824,523 | 7/1974 | McGhee | 439/350 |

FOREIGN PATENT DOCUMENTS

| | | |
|---|---|---|
| 0450988 | 10/1991 | European Pat. Off. . |
| 0585633 | 3/1994 | European Pat. Off. . |
| 2248349 | 4/1992 | United Kingdom . |

*Primary Examiner*—P. Austin Bradley
*Assistant Examiner*—Yong Kim
*Attorney, Agent, or Firm*—Young & Thompson

[57] ABSTRACT

Connector for coaxial cable comprising a first element (10) and a second element (20), these being designed to be fitted together, one in the other, in order to establish an electrical connection between two cores (11, 21) and two earth braids (12, 22), one of the elements (20, 10) including a snap-fastening means (26) while the other element (10, 20) is equipped with a complementary snap-fastening means (16) designed to interact with the snap-fastening means (26) after the two elements (10, 20) have been fitted together: the complementary snap-fastening means (16) is provided on a piece (17) made of insulating material, especially made of plastic, having radial projections (160) designed to become snap-fastened after the fitting operation, the snap-fastening means (26) being formed by a kind of radially projecting collar (39); the radial projections (160) are circumferentially surrounded by an elastic unlocking ring (29) extending around the axis of the connector and with which the radial projections are radially integral.

9 Claims, 4 Drawing Sheets

CONNECTOR FOR COAXIAL CABLE

The invention relates to a connector for coaxial cable, of the kind of those which comprise a first element and a second element, these being designed for being fitted together, one in the other in order to establish an electrical connection between two cores and two earth braids, the first element comprising a central projecting pin intended to be connected to the first core, and a tubular metallic part concentric with the pin, separated from the latter by an insulating central body and intended to be connected to the first braid, the second element comprising a central socket intended to receive the pin and to be connected to the second core, and a tubular metallic part concentric with the socket from which it is separated by an insulating central body, and intended to be connected to the second braid, the two metallic tubular parts being designed to be brought into contact with each other, one of the elements including a snap-fastening means while the other element is equipped with a complementary snap-fastening means designed to interact with the snap-fastening means after the two elements have been fitted together in order to ensure axial connection between these two elements, the snap-fastening means being to the rear of a region of larger diameter of the metallic tubular part surrounding the insulating central body and formed by a kind of radially projecting collar.

A connector of this type, in which the cores and the earth braids are the cores and earth braids of two portions of coaxial cable, the ends of which are equipped with the said connector elements, is described, for example, in FR-A-2, 660,489.

Such a connector, although satisfactory with regard to the assembly and electrical connection which it provides, has the drawback that the two elements can only be disconnected by exerting a force in order to separate the two elements; quite often, especially when this connector is used to connect an aerial cable, in particular on board a motor vehicle, the two elements are not easily accessible and the user or fitter, in order to make the disconnection, pulls on the cable itself, thus running the risk of reducing, long-term, the reliability of the assembly.

In order to alleviate this drawback, it has already been proposed in French Patent Application 94/00692 filed on Jan. 14, 1994 to provide a connector which, while still making it possible to establish good contacts, provides reliable mechanical connection between the two elements and includes means for the simple unlocking of the connection when it is necessary to disconnect the two elements, while at the same time maintaining simple fitting and assembly and economical manufacture.

The object of the present invention is to provide a connector having the same advantages, while having an even simpler construction.

Thus, according to the invention, a connector for coaxial cable, comprising a first element and a second element, these being designed to be fitted together, one in the other, in order to establish an electrical connection between two cores and two earth braids, the first element comprising a central projecting pin intended to be connected to the first core, and a tubular metallic part concentric with the pin, separated from the latter by an insulating central body and intended to be connected to the first braid, the second element comprising a central socket intended to receive the pin and to be connected to the second core, and a tubular metallic part concentric with the socket from which it is separated by an insulating central body and intended to be connected to the second braid, the two metallic tubular parts being designed to be brought into contact with each other, one of the elements including a snap-fastening means while the other element is equipped with a complementary snap-fastening means designed to interact with the snap-fastening means after the two elements have been fitted together in order to ensure axial connection between these two elements, the complementary snap-fastening means being provided on a piece made of insulating material, especially made of plastic, having radial projections designed to become snap-fastened after the fitting-together operation, the snap-fastening means being formed by a kind of radially projecting collar and the above-mentioned piece on which the complementary snap-fastening means are provided consisting of a casing made of insulating material, surrounding the metallic tubular part of the corresponding element of the connector, this casing having the radial projections designed to become snap-fastened behind the above-mentioned collar after the fitting-together operation, is characterized in that the radial projections are circumferentially surrounded by an elastic unlocking ring extending around the axis of the casing of insulating material, and with which the radial projections are integral.

Advantageously, the elastic unlocking ring has a circular cross section.

Preferably, the elastic unlocking ring has a cross section of oblong shape.

Advantageously, the casing has longitudinal openings defining two longitudinal tabs separated from each other in the peripheral sense and extending symmetrically with respect to the axis of the casing of insulating material, the complementary snap-fastening means being provided at the end of the longitudinal tabs, the ends of which are connected annularly by the elastic unlocking ring.

Preferably, when the ring has a cross section of oblong shape, the two longitudinal tabs are in line with those faces of the elastic unlocking ring which are closest together.

Advantageously, the collar has a frustoconical surface, the small base of which, connecting to the metallic tubular part, is located towards the fitting end of the element while the collar has a face located in a plane substantially orthogonal to the axis of the element and corresponding to the large base of the said frustoconical surface.

According to an embodiment variant, the piece made of insulating material, which carries the complementary snap-fastening means, is axially integral with the first element and the snap-fastening means is carried by the tubular metallic part of the second element.

According to another embodiment variant, the snap-fastening means is carried by the tubular metallic part of the first element, and the piece made of insulating material, which carries the complementary snap-fastening means, is axially integral with the second element.

Advantageously, a helical spring is housed inside that one of the metallic tubular parts in which the other metallic tubular part engages.

Elastic tabs, oriented in the longitudinal direction and having a convexity facing the axis of the element, are provided on the internal wall of that one of the tubular metal parts in which the other metallic tubular part engages.

As a variant, elastic tabs oriented in the longitudinal direction have a convexity facing the axis of the element and are provided on a metal sleeve engaged with interference fit inside that one of the metallic tubular parts which engages in the other tubular metallic part.

Advantageously, the two cores and the two earth braids are the cores and the earth braids of two portions of coaxial cable, the ends of which are equipped with the said connector elements.

Preferably, a core and an earth braid are carried by a housing while the other core and the other earth braid are the core and the earth braid of a portion of coaxial cable, the housing and the portion of coaxial cable being equipped with the said connector elements.

The invention consists, apart from the arrangements expounded hereinabove, of a certain number of other arrangements, which will be mentioned more explicitly hereinbelow with regard to embodiment examples which are described with reference to the hereto-appended drawings but which are in no way limiting.

FIG. 1, of these drawings, is an axial section of two elements of a connector in accordance with the invention before being fitted together.

FIG. 2, similar to FIG. 1, shows the two connector elements after being fitted together.

Figure 1:
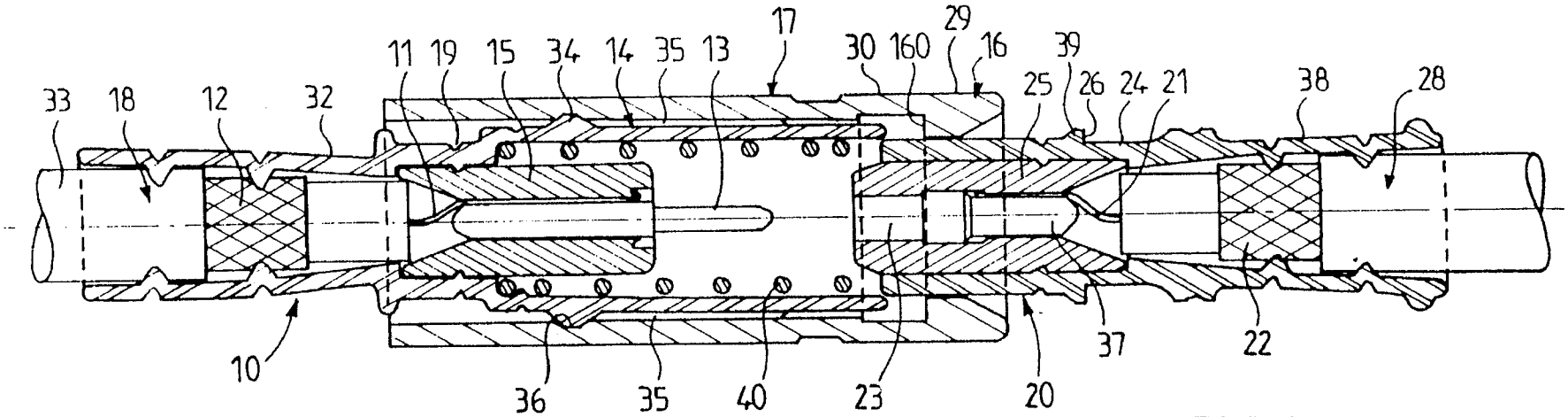
Figure 2:
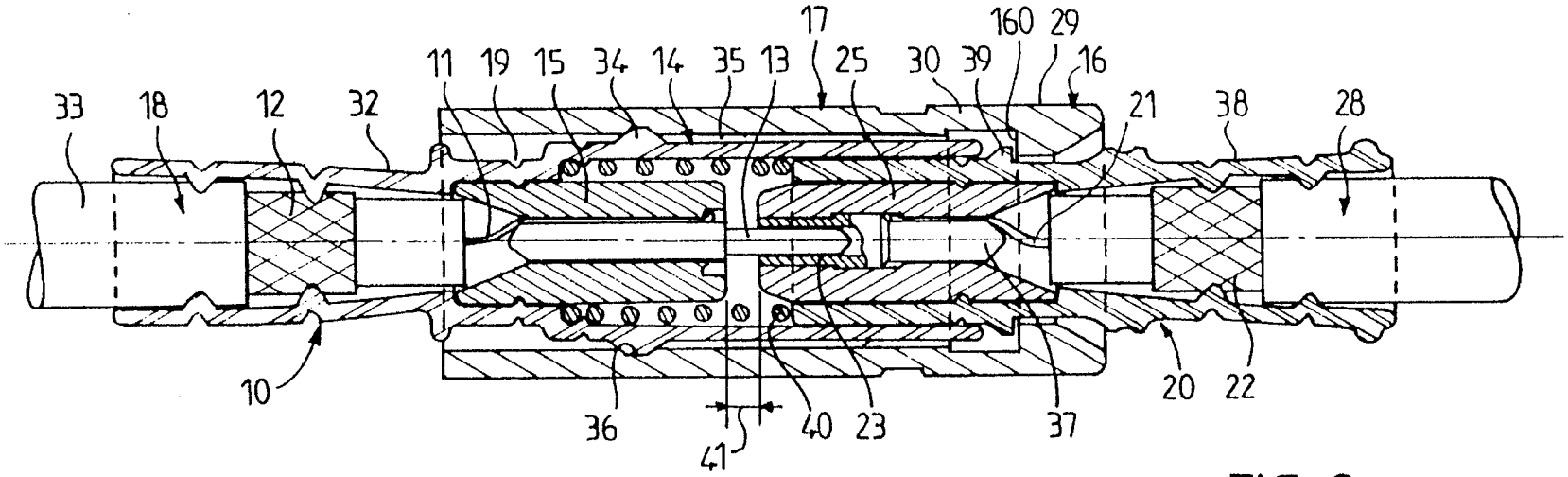

In FIGS. 1 and 2 may be seen a connector for coaxial cable, comprising a first element 10 and a second element 20, these being designed to be fitted together in order to establish an electrical connection between the cores 11, 21 and the earth braids 12, 22 of two portions 18, 28 of coaxial cable, the ends of which are equipped with the said elements 10, 20.

The first element 10 comprises a central pin 13 formed by a cylindrical rod or a rod having a polygonal cross section pushed right into a corresponding housing provided in an insulating central body 15. The stripped end of the core 11 is jammed between the pin 13 and the wall of the housing provided in the central body 15. The pin 13 projects axially from the transverse end face of the central body 15.

Figure 4:
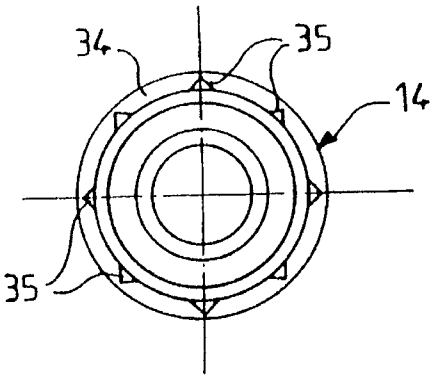
FIG. 4 is a view along the line IV—IV of FIG. 3.
Figure 3:
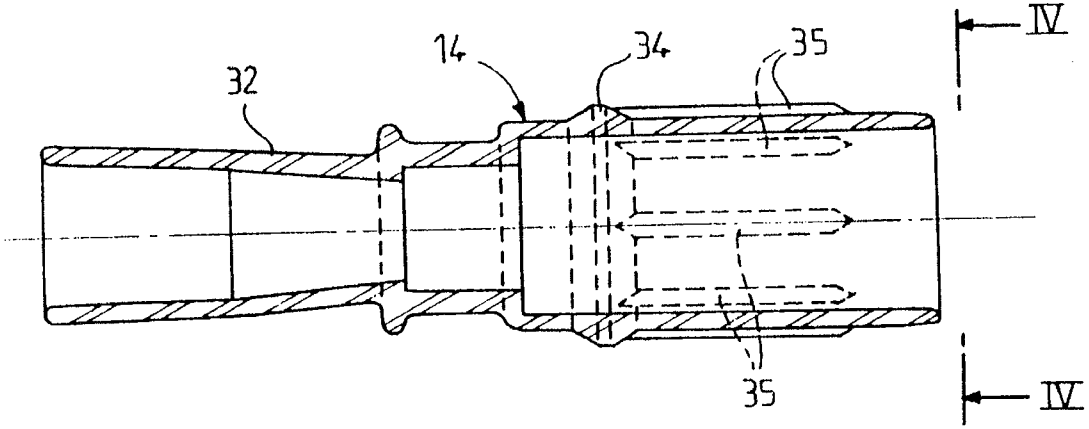
FIG. 3 is an axial section of just the tubular metallic part of the first element.

The element 10 furthermore comprises a tubular metallic part 14 concentric with the pin 13 and held separated from it by the central body 15. The tubular part 14 is visible only in FIGS. 3 and 4. A crimping arrangement 19 anchors the central body 15 in the part 14 which, to the rear of this central body, is extended by a smaller-diameter appendage 32 crimped onto a stripped end region of the braid 12, which provides the electrical connection between the tubular part 14 and the earth braid 12. This appendage 32 is furthermore crimped onto the insulating sheath 33 surrounding the earth braid 12.

Figure 8:
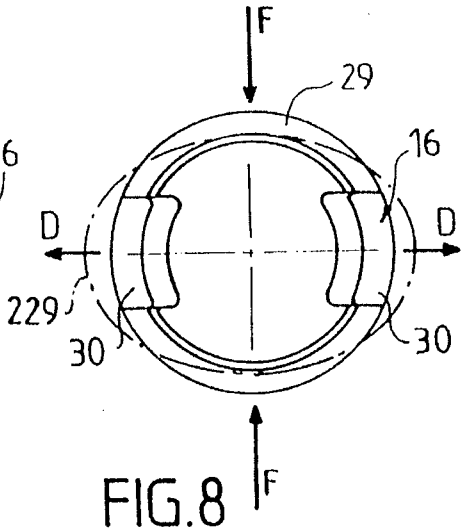
FIG. 8 is a view end on with respect to FIG. 7.
Figure 7:
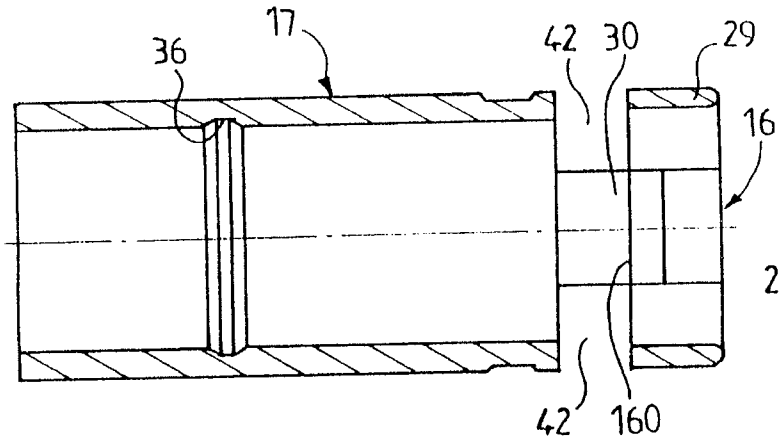
FIG. 7 is an axial section, along the line VII—VII of FIG. 8, of just the piece made of insulating material carrying the complementary snap-fastening means.

A casing 17 made of insulating material, especially made of plastic, surrounds the tubular part 14 and is extended axially from the end of this part 14, towards the right in the representation of FIG. 1. The casing 17 is only shown in FIGS. 7 and 8. The metallic part 14 is anchored in the casing 17 by forcibly fitting the casing 17 over the metallic part 14 and axially positioned by virtue of a projecting flange 34 on the outer surface of the part 14 clipped into a groove 36 in the casing 17. Longitudinal ridges 35 provided on the outer surface of the part 14 extend from the flange 34 and enable the casing 17 to be guided and centred, while at the same time making it easier to force fit the casing 17 over the metallic part 14 and rendering them rotationally integral.

At its front end, the casing 17 includes a snap-fastening means 16 complementary with a snap-fastening means 26 provided on the other connector element 20. The complementary snap-fastening means 16 is formed by inwardly radial projections 160 forming a catch extending along an internal circular contour of the insulating casing 17. Longitudinal openings 42 are provided at the end of this casing 17 in order to define tabs 30 having the catches 160; the ends of the longitudinal tabs 30 are connected annularly by a ring 29 arranged transversely with respect to the axis of the casing 17 of insulating material, in line with the radial projections 160; advantageously, as is shown, the tabs 30 are two in number, these being placed symmetrically with respect to the axis of the casing 17, and the ring is made as one piece with the tabs 30, being moulded with them.

This second element 20 comprises a central socket 23 intended to receive the pin 13. The socket 23 may have longitudinal slits, designed to impart elasticity to the parts delimited by these slits. The socket 23 is mounted in a housing in an insulating central body 25 with a radial clearance sufficient to enable the parts of this socket 23 to move apart elastically in order to receive the pin 13. The socket 23 is extended by a shank 37 having a circular or polygonal cross section suitable for jamming the stripped end of the core 21 of the portion 28 in a housing in the central body 25 in order to make the electrical connection between this core 21 and the socket 23.

Figure 6:
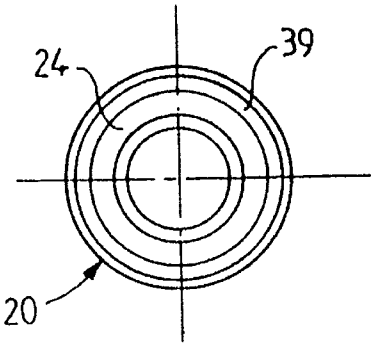
FIG. 6 is a view along the line VI—VI of FIG. 5.
Figure 5:
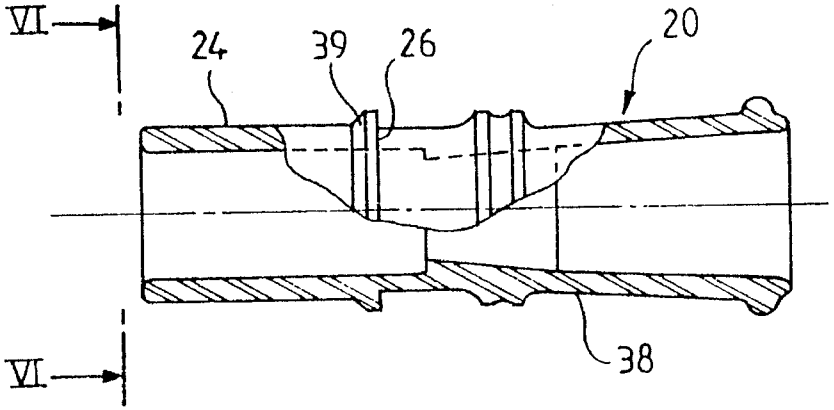
FIG. 5 is an axial section of just the tubular metallic part of the second element.

A tubular metallic part 24, concentric with the socket 23, from which it is separated by the insulating central body 25, covers this central body 25 and is extended on the portion 28 side by a tubular appendage 38 which is crimped onto the cable 28 and onto the stripped end of the earth braid 22. The tubular metal part 24 is only shown in FIGS. 5 and 6.

The external diameter of the metallic tubular part 24 is such that this part can enter the part 14, compressing a helical spring housed in the metallic tubular part 14 of the element 10, which establishes good electrical contact between the parts 14 and 24. The pin 13 penetrates the socket 23.

Towards the rear, the tubular part 24 includes the snap-fastening means 26 formed by a kind of collar 39 which projects radially with respect to the cylindrical surface of the body 24. This collar 39 has a frustoconical surface, the small base of which, connecting to the part 24, is located on the opposite side to the portion 28. On the same side as this portion, the collar 39 has a wall located in a plane substantially orthogonal to the axis of the element 20 and constituting the snap-fastening means 26.

The distance from this wall 26 to the front face of the central body 25 is such that, after inserting the element 20 into the element 10, the projections 160 become snap-fastened behind the collar 39, as shown in FIG. 2, while a clearance 41 remains between the facing transverse faces of the insulating central bodies 15, 25. The maximum diameter of the collar 39 is substantially equal to the diameter of the internal cylindrical surface of the casing 17. The tabs 30 with the catches 160 have a degree of elasticity in the radial direction in order to go over the collar 39 and be snap-fastened behind it. When the elements 10, 20 are in the position of being fitted together, as shown in FIG. 2, it is impossible without applying an abnormally excessive force resulting in damage, for one of the elements to be axially separated from the other and for the connection to be inadvertently unlocked; in order to unlock and disconnect the connector intentionally, an action corresponding to a radial pinching force on the ring 29, as illustrated by the arrows F in FIG. 8, moves the ends of the longitudinal tabs 30 which carry the complementary snap-fastening means 16 away from the axis of the connector, as illustrated by the arrows D, the longitudinal tabs 30 being integral with the ring 29, at least radially, and the complementary snap-fastening means 16 then escapes radially from the snap-fastening means 26: in order to disconnect the connector without difficulty, it is sufficient to separate the elements 10 and 20 axially from each other, the spring 40 automatically providing, of course, the said separation.

According to the example shown in FIGS. 1 to 8 the ring 29 has, at rest, a circular shape; by virtue of the stiffness of the ring 29 made of elastic material, the pinching action along the arrows F, in order to unlock the connector, on those parts of the ring 29 which are not in line with the tabs 30, results in the ring 29 taking up an oblong shape, illustrated by the dot-dash lines 229, the major axis 70 of which then extends in line with the tabs 30, thus moving the radial projections 160 away from the axis of the connector; when the pinching action along the arrows F ceases, the ring 29 resumes its circular shape; in order to assemble the elements of the connector, it suffices, as explained hereinabove, to move these elements closer to each other, against the action of the spring 40, inserting the element 20 into the element 10; it will be noted that this assembly is carried out without difficulty since the element 20, being a body of revolution, it is not necessary to index it circumferentially with respect to the element 10.

Figure 9:
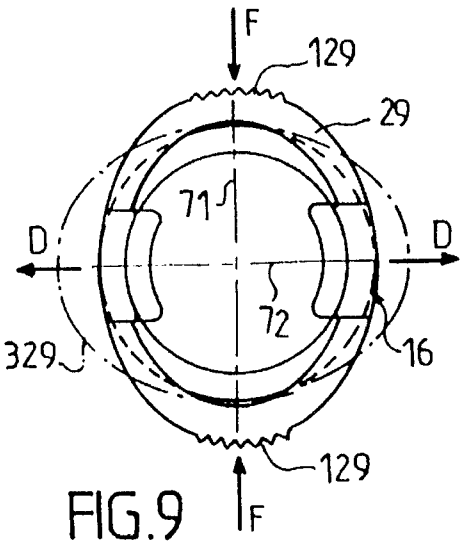
FIG. 9 is a view similar to FIG. 8 and relates to a variant.

FIG. 9 shows a variant in which the ring 29 has, at rest, an oblong shape with a major axis 71 and a minor axis 72, the minor axis 72 of the ring being in line with the tabs 30; the radial pinching, in order to unlock the connector, acts along the major axis 71 of the ring 29 of oblong shape; this arrangement facilitates the unlocking operations since it exposes those parts of the ring 29 on which the radial pinching action is to be exerted, it being possible for the external surface of those parts to be moreover striated, as illustrated at 129; on unlocking, the ring 29 then adopts an oblong shape in which the major and minor axes are reversed, as shown by the dot-dash lines 329.

Figure 10:
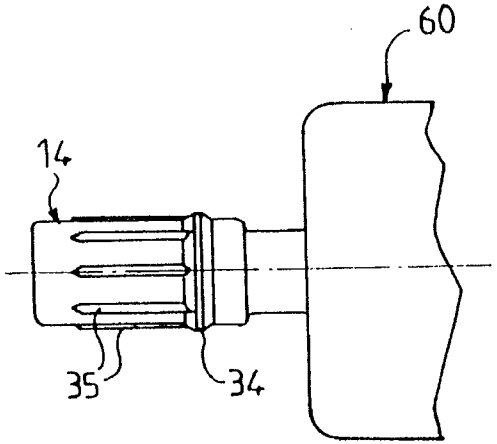
FIG. 10 shows, partially, an element variant.

FIG. 10 shows another example of an application of the connector according to the invention; in this example, one of the elements is firmly attached to the wall of an electronics box 60 to which a coaxial cable is to be connected; according to FIG. 10, the element firmly attached to the box is the element 10 represented here without its external casing 17, only its metallic tubular part 14 being shown in this figure.

Figure 11:
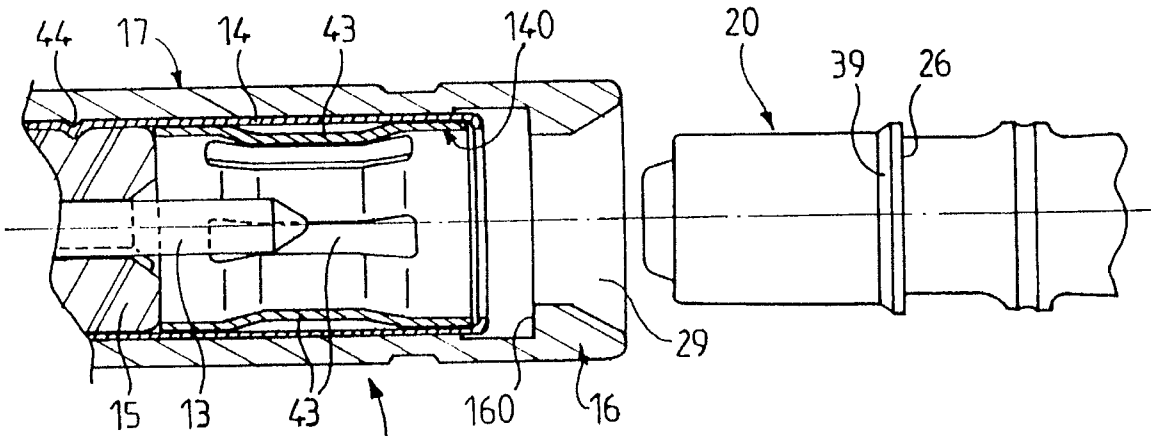
FIG. 11 is a partial view, partially in axial section of another embodiment of a connector according to the invention before being fitted together.

FIG. 11 illustrates an embodiment variant of the connector of FIGS. 1 and 2. The element 20 of FIG. 11 is identical to that of FIG. 1. As regards the element 10, elastic tongues 43 are provided on a metal sleeve 140 engaged with interference inside the cylindrical metallic tubular part 14 in order to make contact with the tubular metallic part 24 of the element 20. The tongues 43 have their convexity facing the axis of the element 10, the sleeve 140 bearing axially against the central insulating body 15. In the insulating casing 17, the metallic tubular part 14 is anchored, for example, by an excrescence 44 made towards the rear of the part 14. When the element 20 is fitted into the element 10, the end of the fitting operation is marked by the snap-fastening of the catches behind the collar; the unlocking of the connection and the disengagement of the connector elements 10, 20 take place as described hereinabove as regard to the variant in the FIGS. 1 to 9 except that there is no spring 40 automatically disconnecting the connector.

According to a variant, not shown, of the embodiment in FIG. 11, it is the cylindrical metallic tubular part 14 which has elastic tongues which are oriented parallel to the axial direction and the longitudinal edges of which are cut out from the wall of the said tubular part 14, these tongues having their convexity facing the axis and being uniformly distributed around the said axis.

Figure 12:
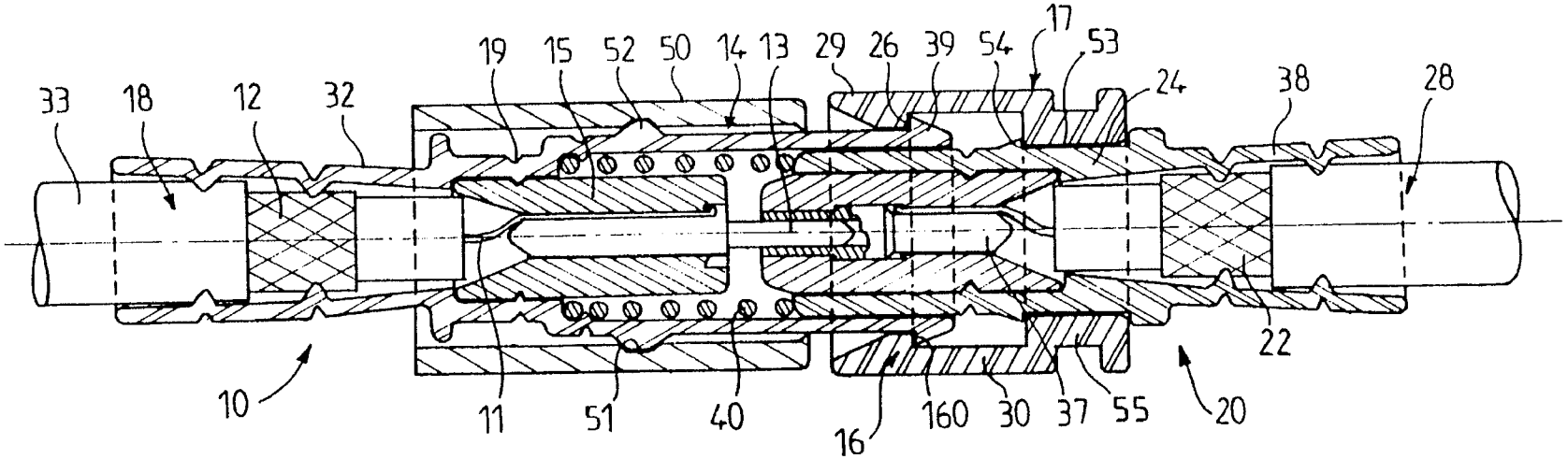
FIG. 12 is similar to FIG. 2, but shows an embodiment variant.
Figure 13:
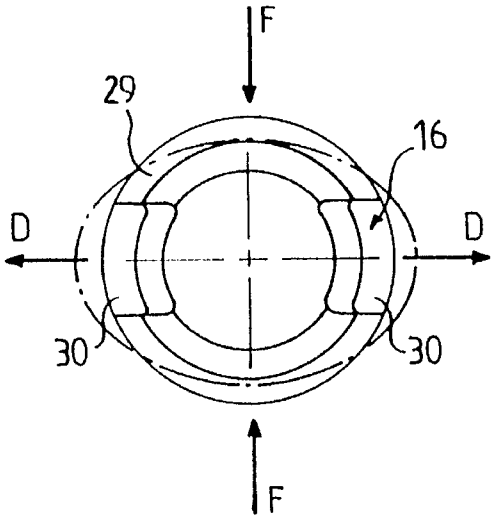
FIG. 13 is similar to FIG. 7, but shows the embodiment variant of the element of the connector of FIG. 12.
Figure 14:
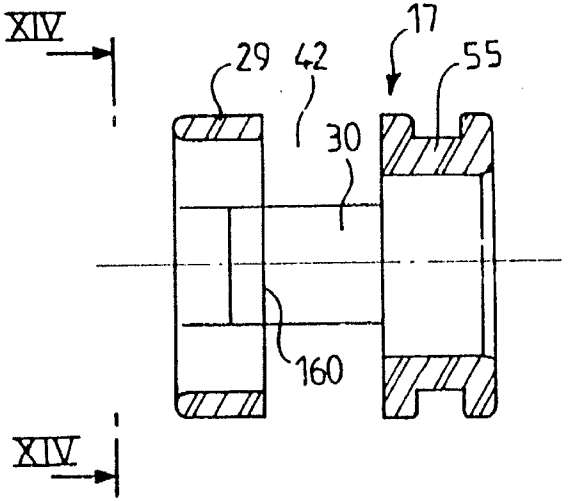
FIG. 14 is a view along XIV—XIV of FIG. 13.

FIGS. 12 to 14 show an embodiment variant of the connector described with regard to FIGS. 1 to 8; those elements shown in these FIGS. 12 to 14 which are identical to and/or act in the same way as those shown in FIGS. 1 to 8 bear the same references. This connector variant, according to FIGS. 12 to 14, is distinguished from the connector in FIGS. 1 to 8 by the fact that the snap-fastening means 26 is carried by the tubular metallic part 14 of the first element 10, while the complementary snap-fastening means 16 is provided on a piece 17 made of insulating material axially integral with the metallic part 24 of the element 20; these are rendered axially integral by inserting a collar 25 provided at the rear of the piece 17 into a groove 53 in the metallic part 24; the said groove 53 is preceded by a conical region 54 making it easier for the metallic part 24 to fit into the piece 17.

The snap-fastening means 26 is, as shown, located on the end of the metallic part 14 so that the piece 17 made of insulating material covers only a small fraction of the external surface of the metallic part 14; in order further to protect the latter, an insulating sleeve 50 is provided around the said metallic part 14 to which this sleeve is secured by a groove 51 which is on the inside of the sleeve interacting with a projecting flange 52 on the external surface of the part 14.

According to a variant, not shown, the snap-fastening means 26 is provided not on the end of the metallic part 14 but shifted towards the cable 18 so that the piece 17, which is axially longer, covers a good fraction of the metallic part 14: this may allow the insulating protective sleeve 50 to be dispensed with.

The operation of such a connector is identical to that described with regard to the connector in the preceding figures.

According to the examples described and shown, the ring 29 is moulded with the radial projections 160 as a single piece; of course, the ring 29 may be a separate piece attached so as to be radially integral with the radial projections 160; the ring 29 may be made of any elastic material, either a plastic or a metal; in the latter case, the ring 29 may be in the form of a retention clip.

What is claimed is:

1. Connector for coaxial cable, comprising a first element (10) and a second element (20), these being designed to be fitted together, one in the other, in order to establish an electrical connection between two cores (11, 21) and two earth braids (12, 22), the first element (10) comprising a central projecting pin (13) intended to be connected to the first core (11), and a tubular metallic part (14) concentric with the pin, separated from the latter by an insulating central body (15) and intended to be connected to the first braid (12), the second element (20) comprising a central socket (23) intended to receive the pin (13) and to be connected to the second core (21), and a tubular metallic part (24) concentric with the socket (23) from which it is separated by an insulating central body (25) and intended to be connected to the second braid (22), the two metallic tubular parts (14, 24) being designed to be brought into electrical contact, one of the elements (20, 10) including a snap-fastening means (26) while the other element (10, 20) is equipped with a complementary snap-fastening means (16) designed to interact with the snap-fastening means (26) after the two elements (10, 20) have been fitted together in order to ensure axial connection between these two elements, the complementary snap-fastening means (16) being provided on a piece (17) made of insulating material, especially made of plastic, having radial projections (160) designed to become snap-fastened after the fitting-together operation, the snap-fastening means (26) being formed by a kind of radially projecting collar (39), the above-mentioned piece on which the complementary snap-fastening means (16) are provided consisting of a casing (17) made of insulating material, surrounding the metallic tubular part (14, 24) of the corresponding element of the connector, this casing (17) having radial projections (160) designed to become snap-fastened behind the above-mentioned collar (39) after the fitting operation, characterized in that the radial projections (160) are circumferentially surrounded by an elastic unlocking ring (29), the cross section of which has an oblong shape, extending around the axis of the casing (17) of insulating material, and with which the projections are radially integral, the casing (17) having longitudinal openings (42) defining two longitudinal tabs (30) separated from each other in the peripheral sense and extending symmetrically with respect to the axis of the casing (17) of insulating material, the complementary snap-fastening means (16) being provided at the end of the said longitudinal tabs (30), the ends of which are connected annularly by the elastic unlocking ring (29), the two longitudinal tabs (30) being in line with those faces of the elastic unlocking ring which are closest together.

2. Connector according to claim 1, characterized in that the collar (39) has a frustoconical surface, a small base of which, connecting to the metallic tubular part (14, 24), is located towards a fitting end of the element (20, 10), while the collar (39) has a face (26) located in a plane substantially orthogonal to the axis of the element (20, 10) and corresponding to a large base of the said frustoconical surface.

3. Connector according to claim 1, characterized in that the piece (17) made of insulating material, which carries the complementary snap-fastening means (16), is axially integral with the first element (10) and the snap-fastening means (26) is carried by the tubular metallic part (24) of the second element (20).

4. Connector according to claim 1, characterized in that the snap-fastening means (26) is carried by the tubular metallic part (14) of the first element (10), and the piece (17) made of insulating material, which carries the complementary snap-fastening means (16), is axially integral with the second element (20).

5. Connector according to claim 1, characterized in that a helical spring (40) is housed inside that one of the metallic tubular parts (14) in which the other metallic tubular part (24) engages.

6. Connector according to claim 1, characterized in that elastic tongues, oriented in the longitudinal direction and having a convexity facing the axis of the element (10), are provided on the internal wall of that one (14) of the tubular metallic parts in which the other metallic tubular part (24) engages.

7. Connector according to claim 1, characterized in that elastic tongues (43), oriented in the longitudinal direction, have a convexity facing the axis of the element (10) and are provided on a metal sleeve (140) engaged with interference inside that one (14) of the metallic tubular parts which engages in the other tubular metallic part (24).

8. Connector according to claim 1, characterized in that the two cores (11, 21) and the two earth braids (12, 22) are the cores and the earth braids of two portions (18, 28) of coaxial cable, the ends of which are equipped with the said connector elements (10, 20).

9. Connector according to claim 1, characterized in that a core (11) and an earth braid (12) are carried by a box (60) while the other core (21) and the other earth braid (22) are the core and the earth braid of a portion (28) of coaxial cable, the box (60) and the portion (28) of coaxial cable being equipped with the said connector elements (10, 20).

* * * * *